United States Patent [19]

Buehler et al.

[11] 4,359,194

[45] Nov. 16, 1982

[54] TWO PIECE MANDRIL FOR QUICK MOUNTING AND RELEASE OF CONES, USED IN TEXTILE INDUSTRY

[75] Inventors: Amsey Buehler, Cobourg; Robert P. Marquis, Bromont, both of Canada

[73] Assignee: Plastech Inc., Cowansville, Canada

[21] Appl. No.: 133,245

[22] Filed: Mar. 24, 1980

[51] Int. Cl.[3] ..... B65H 54/54; B65H 75/30

[52] U.S. Cl. ..... 242/46.3

[58] Field of Search ..... 242/46.3, 46.2, 46.21, 242/46.4, 46.6, 72, 72.1, 68.2

[56] References Cited

U.S. PATENT DOCUMENTS

| | | | |
|---|---|---|---|
| 690,493 | 1/1902 | Wardwell | 242/46.3 |
| 1,996,319 | 4/1935 | Blair | 242/46.3 X |
| 2,746,689 | 5/1956 | Berkepeis | 242/46.3 |
| 2,860,838 | 11/1958 | Keith | 242/46.3 |
| 3,452,941 | 7/1969 | Patton | 242/46.3 |
| 3,592,401 | 7/1971 | Smith et al. | 242/46.3 |
| 3,946,958 | 3/1976 | Chavis | 242/46.3 |

*Primary Examiner*—Stanley N. Gilreath
*Attorney, Agent, or Firm*—Alan Swabey; Robert Mitchell; Guy Houle

[57] ABSTRACT

A mandril for mounting a cone used for winding thread or the like comprising in combination, a first cone-like member having a substantially conical outer surface, the member adapted to receive a shaft therein for use in mounting the mandril, the conical outer surface having abutment means thereon selectively extendable outwardly therefrom to thereby provide selectively, a protuberance on the conical outer surface and a second member, adapted to enter within the first member, means on the second member adapted to engage means on the first member when the first and second members are assembled together, to ensure locking and driving engagement therebetween, the second member also having means thereon cooperatively engageable with the abutment means and arranged such that, in a first position relative to the first member, the abutment means will not be extended by the means but in a second position relative to the first member, the abutment means will be extended by the means, outwardly of the surface to thereby provide the protuberance on the conical outer surface for use in positively securing the cone upon the mandril for driving engagement therewith.

21 Claims, 15 Drawing Figures

TWO PIECE MANDRIL FOR QUICK MOUNTING AND RELEASE OF CONES, USED IN TEXTILE INDUSTRY

BACKGROUND OF THE INVENTION

1. Field of the Invention

This invention relates to mandrils for mounting cones of the type used in the winding of thread or the like and more particularly to ones of the quick release type.

2. Statement of the Prior Art

Numerous mandril devices are known, such include Berkepeis's U.S. Pat. No. 2,746,689 dated May 22, 1956; Patton's U.S. Pat. No. 3,452,941 dated July 1, 1969; Chavis's U.S. Pat. No. 3,946,958 and Smith et al's U.S. Pat. No. 3,592,401 dated July 13, 1971.

A major drawback in respect of the aforementioned examples of prior art devices and also numerous other devices in the prior art, is their relatively complicated design, which apart from involving high manufacturing costs, involves the matter of reliability.

SUMMARY OF THE INVENTION

It is therefore a prime object of the present invention to provide an improved mandril of the type described which will overcome the aforementioned disadvantages, accordingly to provide a mandril of relatively simple design having a minimum number of parts and which is relatively inexpensive to produce.

It is a further object of the present invention to provide a mandril which is simple to operate from the point of view of quickly locking the cone in place on the mandril and quickly releasing the cone from the mandril.

It is a further important object of the present invention to provide a mandril whose design lends itself to the use of relatively inexpensive materials.

It is a further important object of the present invention to provide a precision made mandril which may be readily mass produced. Thus, providing a mandril wherein the parts comprising the mandril include close tolerance dimensions allowing for ready interchange ability of parts comprising the mandril and further ensure any one mandril produced will readily receive, properly mount and secure a precision made cone thereon.

It is yet a further important object of the present invention to provide a mandril where, by virtue of its design, the components thereof can be produced using a molding process.

In one aspect of the present invention there is provided a mandril for mounting a cone used for winding thread or the like comprising a two piece construction. The two pieces, by virtue of their design, may be readily moulded from plastic or other suitable materials. The mandril according to the present invention includes: a conical outer shape upon which a selectively movable protuberance or abutment is provided for aiding driving engagement between the mandril parts, when such are assembled together in readiness for operation. The mandril according to the present invention features, as is apparent from the present disclosure, a snap action when locking the pieces of the mandril together.

These and other important objects will become apparent from the description hereinafter.

BRIEF DESCRIPTION OF THE DRAWINGS

The invention is illustrated by way of example in the accompanying drawings wherein.

DESCRIPTION OF THE PREFERRED EMBODIMENTS

Figure 2:
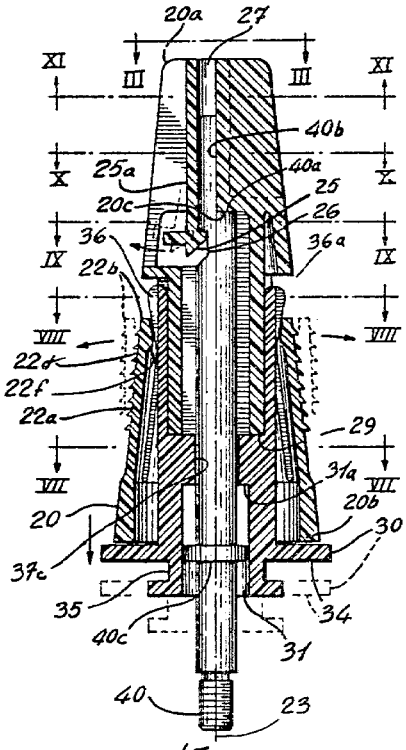
FIG. 2 is a further sectioned view of the mandril shown in FIG. 1 with the parts assembled including the shaft for mounting the mandril.

Referring now in detail to the drawings. FIG. 2 illustrates a mandril assembly 10 having a first cone-like portion 20, a second elongated portion 30 and a shaft 40.

Figure 1:
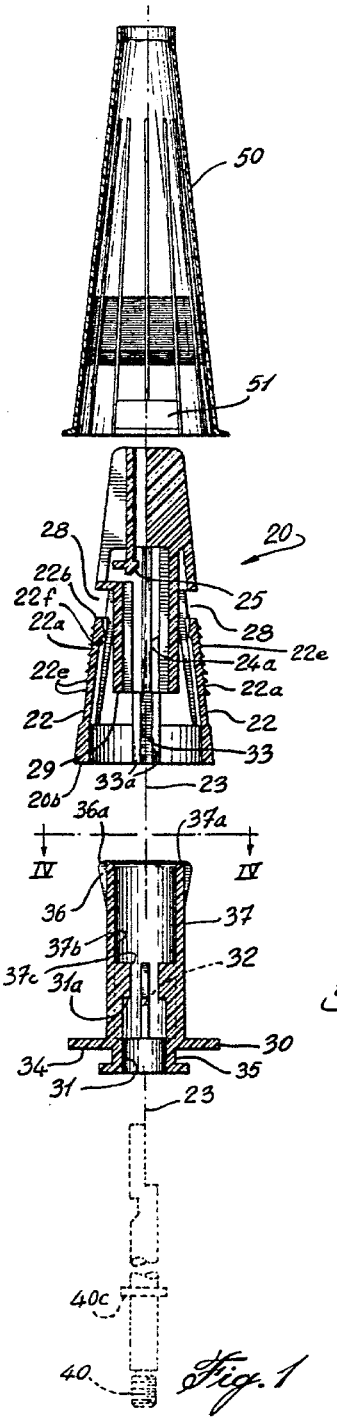
FIG. 1 is a composite sectioned view showing the components of a mandril in accordance with the present invention including a cone of the type for mounting upon the mandril and a shaft for mounting the mandril.
Figure 5:
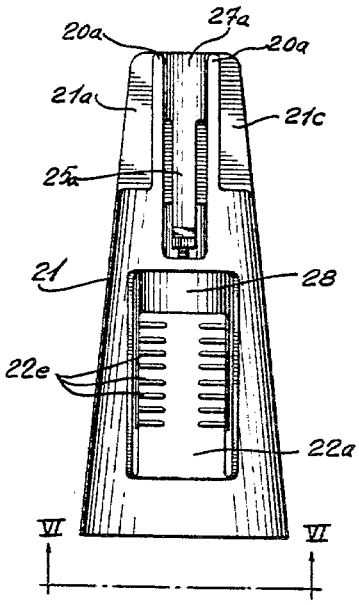
FIG. 5 is a side elevational view of a component shown in FIGS. 1 and 2.
Figure 7:
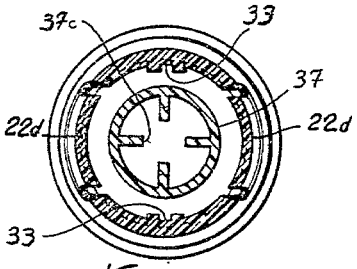
FIGS. 7, 8, 9, 10 and 11 are a series of sectional views taken along respective lines VII—VII, VIII—VIII, IX—IX, X—X and XI—XI in FIG. 2.

Cone-like porton 20, the detail of which is clearly evident from FIGS. 1, 2 and 5, comprises a substantially conical outer surface 21 and wall 22, wall 22 being arranged symmetrically about longitudinal central axis 23. Portion 20 further includes a bore 24 extending along at least part of axis 23 and being of suitable size to receive shaft 40 for use in mounting mandril assembly 10. Adjacent one end of portion 20, namely the apex end **20*a*, being remote from the opposite base end 20*b* of the cone-like shape, includes means for positively securing shaft 40 thereto, such comprising a moveably mounted abutment 25 secured to portion 20 and adapted for engaging notch 26 in shaft 40. As readily seen in FIG. 1, abutment 25 and notch 26 cooperate with face 40*a* of shaft 40 and face 20*c* of portion 20, to positively secure shaft 40 to portion 20. Abutment 25 is springingly held in the position shown, for example in FIG. 2, by flexible member 25*a*. Portion 20 also includes means for positively securing shaft 40 for rotation therewith, such comprising part circular shaped aperture 27, best seen in FIG. 3, for accommodating flat 40*b* on shaft 40**.

It will be apparent to ones skilled in the art, other suitable means maybe employed to secure shaft 40 within portion 20 for positively securing the same thereto and ensuring positive rotation of shaft 40 therewith.

Conical outer surface 21 and wall 22 include therein a pair of tongues **22*a*. As best seen in FIGS. 1 and 2, tongues 22*a* are secured adjacent base end 20*b* and extend upwardly of conical surface 21 and accordingly wall 22 to terminate in free ends 22*b*. Due to the thickness and flexibility of wall 22, tongues 22*a* may be selectively displaced relative to the remaining conical outer surface 21 adjacent thereto to thereby provide, selectively, a protuberance on conical surface 21. Portion 20 further includes a pair of rectangular shaped apertures 28 in conical wall 22 and accordingly surface 21 adjacent free ends 22***b* of tongues 22*a*. It will be noted tongues 22*a* are located diametrically opposite one another on respective opposite sides of conical outer surface 21 and include arcuate outer surfaces 22*d* extending in a circumferential direction, and which prior to being displaced, as discussed hereinafter, form part of conical outer surface 21. As further seen in FIGS. 1 and 2 for example, tongues 22*a* include ridges 22*e* on the outer surface thereof, as may also surface 21, if desired, for use in gripping a cone placed thereon.

Ridges 22*e* may, if desired, extend over substantially the entire surfaces 21 and 22*e* or at least over the upper part of surface 21, extending to include the upper outer surface portions of tongues 22*a*.

Tongues 22*a* may be of any suitable dimension in both length, width and thickness. In one instance, a tongue length of approximately 2 inches, width of approximately 1 inch and a thickness of approximately $\frac{1}{8}$ inch, has been found satisfactory to ensure proper operation of the mandril assembly 10.

Figure 6:
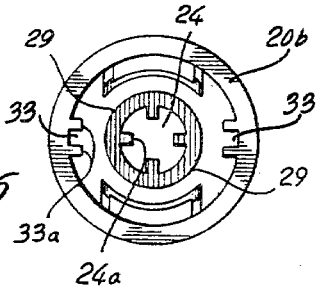
FIG. 6 is an end view of the component shown in FIG. 5 taken along the line VI—VI of FIG. 5.
Figure 8:
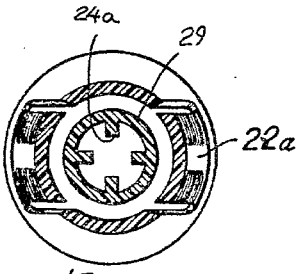
Figure 9:
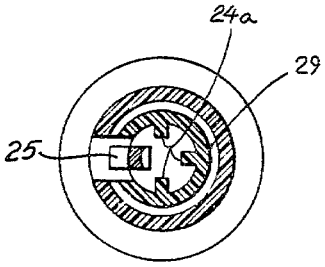
Figure 10:
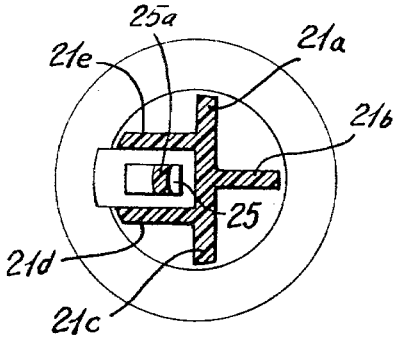
Figure 11:
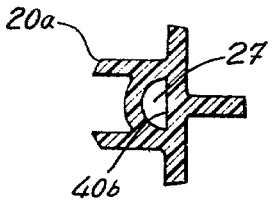

Referring FIGS. 1 and 2, there is seen portion 20 also includes an elongated tubular member 29 extending within wall 22 and from the inner apex area of cone-like portion 20 and thus provides bore 24 for receiving shaft 40. Bore 24, as more clearly seen in FIG. 6, is defined by inward projecting portions 24*a* indicated in FIGS. 1 and 6.

Figure 3:
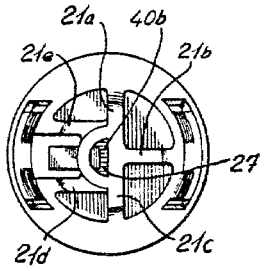
FIG. 3 is an end view of the mandril shown in FIG. 2 taken along the line III—III of FIG. 2.

As best seen in FIG. 3, portion 20 terminates at the apex portion thereof in a plurality of extending rib members 21*a*, 21*b*, 21*c*, 21*d* and 21*e* and provide a plurality of cavities therebetween.

Figure 12:
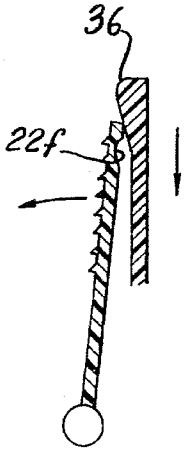
FIGS. 12, 13 and 14 are part sectional views showing alternative designs of portions of a component comprising the mandril shown in FIGS. 1 and 2.
Figure 13:
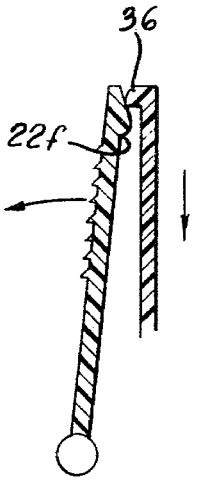
Figure 14:
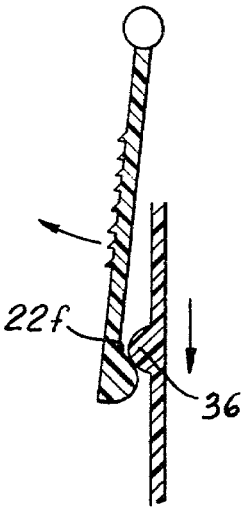

If desired, tongue 22*a* may be arranged to extend downwardly as for example shown in FIG. 14. Alternatively, tonques 22*a* may be arranged as shown in FIGS. 12 and 13, the functioning of which is discussed hereinafter.

Figure 15:
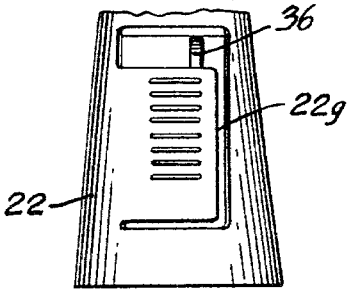
FIG. 15 is a partial side elevational view of the component shown in FIG. 5 showing an alternative tongue arrangement.

FIG. 15 discloses yet a further alternative tongue mounting arrangement. As seen, tongue 22*g* is secured to conical wall 22 via a side thereof extending upwardly of conical wall 22. Thus, tongue 22*g* is arranged to hinge in a direction normal to that of tongue 22*a*. Tongue 22*g* thus provides an alternative type of protuberance to that shown in FIG. 2 and which may, if desired, be adapted to be moved outwardly of conical outer surface 21 by portion 30 in similar manner to that described in respect of tongue 22*a* discussed hereinafter. It will be readily appreciated by those skilled in the art, various alternative means to that shown may be provided on portion 30 to move tongue 22*g* outwardly of conical surface 21.

As will be readily appreciated from for example FIGS. 1 and 2 and the foregoing description, the designs of cone-like portion 20 as well as portion 30, more clearly described hereinafter, readily lend themselves to being molded in a suitable plastic material.

As will be apparent to those skilled in the art from both the foregoing description and that hereinafter, other suitable means besides tongues 22*a* and 22*g* and means to move the same, may be utilized to provide abutment means on wall 22 and accordingly surface 21, which is selectively extendable outwardly therefrom to thereby provide selectively a protuberance on surface 21.

Second elongated portion 30, is adapted to enter within first cone-like portion 20 and includes a bore 31 extending lengthwise and substantially centrally of the longitudinal axis 23. As readily seen in FIG. 2, portion 30 is adapted to slidably engage collar-like portion 40*c* of shaft 40 and thus provide support for shaft 40. Such support for shaft 40 is optional, as the function of the collar-like portion 40*c* is primarily for providing a stop member limiting relative movement of portions 20 and 30, as will become more apparent from the description hereinafter.

Figure 4:
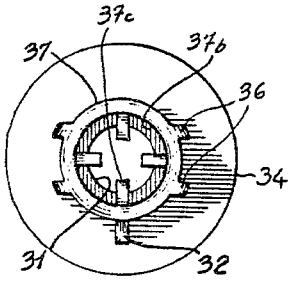
FIG. 4 is a full end view taken along line IV—IV in FIG. 1.

As best seen respectively in FIGS. 4 and 1, portion 30 includes abutment 32 and portion 20 includes slot 33 defined by projections 33*a* for use in locking portions 20 and 30 together for driving engagement therebetween. As portion 30 is introduced within portion 20, abutment 32 slides into slot 33. Alternatively, it will be appreciated abutment 32 may be on portion 20 and slot 33 located in portion 30.

Portion 30 further includes circular flange 34 adapted to engage base end 20*b* of portion 20 and provides a side wall of groove 35 adapted to be engaged by means (not shown) for use in selectively moving portion 20 relative to portion 30, the purpose of which will become more apparent from the description hereinafter.

Portion 30, as best seen in FIG. 2, further includes abutment means 36 adapted, in a first position, relative to portion 20, as shown in FIG. 2, to protrude into aperture 28. As seen, abutment means 36 protrudes into aperture 28 without substantially displacing tongue 22*a* and, when portion 30 is slidably moved outwardly of portion 20 and accordingly in a direction away from base end 20*b*, free end 22*b* of tongue 22*a* rides upon abutment means 36 and, due to the contour of the same, i.e., being inclined, tongue 22*a* is displaced outwardly of surface 21 thus providing a protuberance on conical outer surface 21 for use in positively securing said cone upon mandril assembly 10 for driving engagement therewith.

As seen, portion 30 further includes an elongated tubular member 37 extending therefrom to terminate in a free end 37*a*, the inner wall 37*b* of member 37 being adapted to provide a sliding spigot fit on the outer wall of tubular member 29 extending within and from portion 20 about central axis 23. As will be noted, free end 37*a* includes abutment means 36 having an inclined raised surface of selected width, which may vary as desired to suit the width of aperture 28 or alternatively, comprise a pair of spaced portions adapted to protrude into aperture 28 adjacent respective ends thereof, when said aperture is of rectangular shape. As further seen, the inclined surface of abutment means 36 faces away from free end 37*a* and the peek area 36*a* is adapted to enter aperture 28. Thus, abutment means 36 has a contour for use in displacing tongue 22*a*.

As will be apparent to those skilled in the art, one tongue 22*a* or more, together with companion abutment means 36 may be utilized.

As seen in FIGS. 2 or 3, shaft 40, which may be made of any suitable material including steel, includes a flat 40*b* located adjacent a terminal end thereof, a notch 26 spaced from flat 40*b* and facing in a direction opposite to that of flat 40*b* also that shaft 40 further includes collar-like portion 40*c* located intermediate notch 26 and the other terminal end of shaft 40, remote from flat 40*b*.

In order to ensure proper operation of mandril assembly 10, means is provided therein to lock portion 20 and portion 30 in said first and second positions for use in respectively releasing and securing said cone to mandril assembly 10. Such is accomplished with the use of the means (not shown) engaging groove 35 to move portion 30 selectively inwardly or outwardly of portion 20. The means for locking in said respective first and second positions comprises flange 34 engaging base end 20*b* of portion 20 in cooperation with free end 22*b* of tongue 22*a* engaging portion 30 adjacent the base of abutment means 36, for releasing said cone from mandril assembly 10 and, collar-like portion 40*c* abutting the end of face 31*a* of bore 31 in cooperation with engagement of free end 36*a* with recess 22*f* in tongue 22*a* for positively securing said cone to mandril assembly 10.

FIG. 1 discloses one example of a cone 50 for use upon a mandril assembly in accordance with the present invention. Such cone, may be made of plastic material. Unlike cones commonly in use, a blank label 51 is provided on the inner wall surface adjacent the base of the cone for use in recording desired information, located remote from ridges 22*e*.

We claim:

1. A mandril for mounting a cone used for winding thread or the like comprising in combination:

(a) a first cone-like member having a substantially conical outer surface arranged symmetrically about the longitudinal central axis of said member, an aperture in said member extending along at least part of said central axis and adapted to receive a shaft therein for use in mounting said mandril, said member also including means for positively securing said shaft thereto and for rotation therewith, said conical outer surface having abutment means thereon selectively extendable outwardly therefrom to thereby provide selectively, a protuberance on said conical outer surface;

(b) a second member, at least part of which is within said first member, said second member having a bore therein extending lengthwise and substantially centrally of the longitudinal axis of said second member, means on said second member continuously interlockingly engaging means on said first member to ensure positive locking and positive non-frictional driving engagement therebetween, said second member having means thereon for engagement by further means for selectively moving said second member inwardly or outwardly of said first member, said second member also having means thereon cooperatively engageable wih said abutment means and arranged such that, in a first position relative to said first member, said abutment means will not be extended by said means but in a second position relative to said first member, said abutment means will be extended by said means outwardly of said surface to thereby provide said protuberance on said conical outer surface for use in positively securing said cone upon said mandril for driving engagement therewith.

2. A mandril for mounting a cone used for winding thread or the like, comprising in combination:

(a) a first cone-like portion having an apex end and a base end, said portion having a substantially conical outer surface and wall arranged symmetrically about the longitudinal central axis of said portion, a bore in said portion extending along at least part of said central axis and adapted to receive a shaft therein for use in mounting said mandril, said portion also including means for positively securing said shaft thereto and means for ensuring rotation therewith, said conical outer surface and wall including a tongue or the like portion therein, the free end of said tongue extending upwardly of said conical outer surface toward said apex end and said tongue being selectively displaceable relative to the remaining conical outer surface adjacent thereto, to thereby provide, selectively, a protuberance on said conical surface, and an aperture in said conical surface and wall adjacent said free end of said tongue;

(b) a second elongated portion, part of which is adapted to enter within said first portion, said second portion having a bore therein extending lengthwise and substantially centrally of the longitudinal axis of said second portion, and adapted to slidably engage said shaft and support the same, means on said second portion adapted to engage means on said first portion when said first and second portions are assembled together to ensure positive locking and positive driving engagement therebetween, said second portion having means thereon for engagement by further means for selectively moving said second portion relative to said first portion, said second portion also having abutment means thereon adapted, in a first position relative to said first portion, to protrude into said aperture without substantially displacing said tongue and whereupon when said second portion is slidably moved outwardly of said first portion and accordingly in a direction away from the said base end of said cone-like portion to a second position, said free end of said tongue will ride upon said abutment means and due to the contour of said abutment means, displace itself outwardly of said conical outer surface and provide said protuberance on said conical outer surface for use in positively securing said cone upon said mandril for driving engagement therewith.

3. A mandril as defined in claim 2 wherein said first portion includes a pair of said tongue portions located diametrically opposite one another on respective opposite sides of said conical outer surface.

4. A mandril as defined in claim 3 wherein each of said tongue portions include an arcuate outer surface extending in a circumferential direction and which prior to being displaced, form part of said conical outer surface.

5. A mandril as defined in claim 4 wherein said tongue portions are secured to said conical outer surface and wall adjacent said base end of said cone-like portion.

6. A mandril as defined in claim 4 wherein said arcuate outer surfaces include ridges for use in gripping said cone.

7. A mandril as defined in claim 6 wherein said ridges are confined to an area adjacent said free end of said tongues.

8. A mandril as defined in claim 2 wherein said means for positively securing said shaft comprises a moveably mounted abutment secured to said first portion for engaging a notch in said shaft.

9. A mandril as defined in claim 2 wherein said means for positively securing said shaft for rotation with said first cone-like portion comprises a part circular shaped aperture in said first cone-like portion for use in accommodating a flat on said shaft.

10. A mandril as defined in claim 2 wherein said aperture is rectangular in shape.

11. A mandril as defined in claim 2 including means for locking said first cone-like portion and said second elongated portion in said respective first and second positions.

12. A mandril as defined in claim 11 wherein said means for locking in said respective first and second positions comprises a flange on said second elongated portion engageable with the base of said first cone-like portion, in cooperation with the free end of said tongue engaging a portion of said abutment means remote from the free end thereof and an abutment on said shaft engageable with an end face of a bore in said second elongated portion, in cooperation with engagement of the free end of said abutment means with a recess in said tongue.

13. A mandril as defined in claim 2 wherein said means to ensure locking and driving engagement of said first and second portions comprises an abutment on a selected one of said first and second portions adapted to slidably engage a slot in the other of said portions.

14. A mandril as defined in claim 2 wherein said means on said second portion for engagement by said further means for selectively moving said second portion relative to said first portion comprises a circular groove.

15. A mandril as defined in claim 2 wherein said second elongated portion includes a first elongated tubular member extending therefrom to terminate in a free end, the inner wall of said tubular member being adapted to provide a sliding spigot fit on the outer wall of a second elongated tubular member extending within and from said first portion, about said central axis, the outer wall surface of said first elongated tubular member including, adjacent said free end, an inclined raised surface of selected width, said inclined surface facing away from said free end, the peek area of said inclined surface being adapted to enter said aperture, to provide said abutment means having said contour, for use in displacing said tongue.

16. A mandril as defined in claim 4 wherein the length of each of said arcuate surfaces is about 1 inch and the thickness of the respective tongues is about $\frac{1}{8}$ inch.

17. A mandril as defined in claim 2 wherein said aperture is rectangular in shape and said abutment means on said second portion adapted to protrude into said aperture comprises a pair of spaced portions arranged to protrude into said aperture adjacent respective ends thereof.

18. A mandril as defined in claim 2 wherein said first cone-like portion and said second elongated portion are made from plastic material.

19. A mandril as defined in claim 2 wherein said first cone-like portion and said second elongated portion are made from nylon material.

20. A mandril as defined in claim 2 including said shaft.

21. A mandril as defined in claim 20 wherein said shaft includes a flat thereon adjacent a first terminal end thereof, a notch in said shaft spaced from said flat facing in a direction opposite to that of said flat, and said shaft further including a collar like portion thereon located intermediate said notch and the second terminal end of said shaft.

* * * * *